US006658794B1

(12) United States Patent
Hansel et al.

(10) Patent No.: US 6,658,794 B1
(45) Date of Patent: Dec. 9, 2003

(54) GUIDE ASSEMBLY FOR A TILT-OUT SASH WINDOW

(75) Inventors: Thomas J. Hansel, Rockford, IL (US); Julie K. Earp, Rockford, IL (US); Charles H. Graham, Rockford, IL (US); George E. Heid, Rockford, IL (US); William M. Martz, Rockford, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/511,464

(22) Filed: Feb. 23, 2000

(51) Int. Cl.[7] ..... E05D 15/22
(52) U.S. Cl. ..... 49/181; 49/176
(58) Field of Search ..... 49/176, 181, 183, 49/445, 446, 463

(56) References Cited

U.S. PATENT DOCUMENTS

| | | | | | |
|---|---|---|---|---|---|
| 2,056,847 | A | | 10/1936 | Garcia | 20/49 |
| 3,399,490 | A | * | 9/1968 | Hettinger | 49/176 X |
| 3,797,168 | A | | 3/1974 | Trout | 49/181 |
| 3,842,540 | A | | 10/1974 | Anderson | 49/181 |
| 3,861,082 | A | | 1/1975 | Dau | 49/181 |
| 4,452,012 | A | | 6/1984 | Deal | 49/181 |
| 4,590,708 | A | | 5/1986 | Campodonico | 49/181 |
| 4,610,108 | A | | 9/1986 | Marshik | 49/181 |
| 4,683,675 | A | | 8/1987 | Guelck | 49/181 |
| 4,683,676 | A | | 8/1987 | Sterner, Jr. | 49/181 |
| 4,718,194 | A | | 1/1988 | FitzGibbon et al. | 49/181 |
| 4,914,861 | A | * | 4/1990 | May | 49/181 |
| 4,922,657 | A | | 5/1990 | Foss | 49/181 |
| 4,958,462 | A | | 9/1990 | Cross | 49/181 |
| 5,027,557 | A | * | 7/1991 | May | 49/181 |
| 5,168,665 | A | | 12/1992 | Goldenberg | 49/172 |
| 5,210,976 | A | | 5/1993 | Cripps | 49/181 |
| 5,243,783 | A | | 9/1993 | Schmidt et al. | 49/181 |
| 5,301,467 | A | | 4/1994 | Schmidt et al. | 49/181 |
| 5,371,971 | A | | 12/1994 | Prete | 49/380 |
| 5,383,303 | A | | 1/1995 | Nakanishi et al. | 49/181 |
| 5,566,507 | A | | 10/1996 | Schmidt et al. | 49/428 |
| 5,669,180 | A | | 9/1997 | Maier | 49/181 |
| 5,697,188 | A | | 12/1997 | Fullick et al. | 49/181 |

* cited by examiner

*Primary Examiner*—Jerry Redman
(74) *Attorney, Agent, or Firm*—Marshall, Gerstein & Borun

(57) ABSTRACT

A guide assembly or balance shoe assembly for slidably and pivotably mounting a window sash to a window jamb is disclosed. The guide assembly includes a shoe housing having sliding surfaces that guide the housing in the jamb channel. A sash pivot is coupled to the window sash and a locking cam is rotatably coupled within the shoe housing. The locking cam includes a sash pivot that retains the sash pivot pin. The locking cam rotates substantially with the sash pivot and the locking cam has a locking surface that is configured to engage the jamb channel when the sash pivot is rotated to a first position.

22 Claims, 13 Drawing Sheets

GUIDE ASSEMBLY FOR A TILT-OUT SASH WINDOW

FIELD OF THE INVENTION

The present invention relates generally to a sash window with a guide assembly. Particularly, the present invention relates to a double-hung sash window wherein the window sash can be pivotally titled out of the window frame. More particularly, the present invention relates to a double-hung sash window having a guide assembly configured to guide the window sash in the jamb channel of the window frame and to secure the window sash to the window frame when the window sash is titled out of the window frame.

BACKGROUND OF THE INVENTION

It is known to provide a window for a home (or other building) with a window frame having rigid extrusions made from vinyl or other plastics), wood, aluminum, or other applicable materials and is used in combination with a window sash which may be made from wood, vinyl, aluminum, or other applicable materials. Generally, windows of this type include a "double-hung" window sash that is guided in a jamb channel (or jamb liner) of the window frame so that it is slidable relative to the window frame.

It is also known in a "double-hung" window base to provide the window sash with two pivot points, typically at the base of the window sash, to allow the window sash to be pivoted or "tilted" out of the window frame so that the exterior of the window sash can be accessed (i.e. for washing, painting, and/or repair) from the interior of the home or building.

In such known windows, counter-balance systems have been used to hold the window sash in an open position or closed position. Such known systems may include a counter-weight or spring balance assembly of some kind (i.e. that may operate in conjunction with an "interference" between the window sash and the jamb channel of the window frame). Typically, spring balance assemblies are enclosed in the jamb channels on each side of the window sash.

However, a problem encountered with conventional windows having a tilt-out window sash is construction of a suitable mechanism for the retention of the end of the counter-balance spring assembly that must be removably secured to the window sash (to allow "tilting" out). While the window sash may be tilted out of the frame (or may be completely removable), it is desirable that the window sash (which otherwise may move within the jamb channel from an open position to a closed position) not be movable within the jamb channel once tilted out (or when its full weight is not available to offset the pull of a spring balance assembly).

In windows that employ an "interference" counter-weight or spring-balance assembly, for example, including a balance shoe assembly with a balance "shoe" slidable in the jamb channel and engageable with the window sash (i.e. moving with the window sash when it is engaged), it is desirable that when tilting the window sash, the balance shoe assembly be retained in a fixed position within the jamb channel.

Locking mechanisms such as a positive locking arrangement for a balance shoe assembly are known. However, such known balance shoe assemblies typically require a plurality of parts, which makes them more difficult or costly to manufacture and assemble. Moreover, such known balance shoe assemblies typically do not provide for convenient yet secure removal of the window sash from the window frame.

Accordingly, it would be advantageous to provide a sash window with a guide assembly that includes a minimal number of parts and yet provides an adequate holding force when the window sash is tilted out. It would also be advantageous to provide a guide assembly in the frame of a balance shoe assembly that is simple and inexpensive to manufacture and assemble. It would further be advantageous to provide a balance shoe assembly that retains a sash pivot pin adequately when the sash is in the tilted out position, for example, in the balance shoe assembly, but still allows easy disengagement of the sash pivot pin from the balance shoe assembly and that also allows for removal of the window sash from the window frame. It would be desirable to provide for a sash window with a guide assembly providing at least some of these and other advantageous features.

SUMMARY OF THE INVENTION

The present invention relates to a guide assembly for translationally and pivotally mounting a window sash to a window frame providing a window jamb having a jamb channel. The guide assembly includes a housing configured for translating movement within the jamb channel. The guide assembly also includes a sash pivot configured to be coupled to the window sash. Further, the guide assembly includes a locking cam rotatably coupled to the housing. The locking cam includes a sash pivot retaining region. The locking cam also includes a surface configured to engage the jamb channel when the sash pivot is rotated to a first position.

Another exemplary embodiment of the invention also relates to a window. The window includes a window frame having a jamb channel and a window sash movable relative to the window frame. The window further includes a shoe housing including a sliding surface for guiding the housing in the jamb channel. The window also includes a sash pivot configured to be coupled to the window sash. Further still, the window includes a locking cam rotatably coupled to the shoe housing. The locking cam includes a sash pivot retaining region and the locking cam is configured to rotate substantially with the sash pivot. The locking cam includes a locking surface configured to engage the jamb channel when the sash pivot is rotated to a first position.

Still another exemplary embodiment of the invention further relates to a locking sash shoe for slidably and pivotably mounting a window sash to a window jamb, the window jamb having a jamb channel. The sash shoe includes a shoe housing with a sliding surface for guiding the housing in the jamb channel. The sash shoe also includes a sash pivot configured to be coupled to the window sash. The sash shoe also includes a locking cam rotatably coupled to the shoe housing. The locking cam includes a sash pivot retaining region. The locking cam is configured to rotate substantially with the sash pivot. The locking cam includes an integrally formed locking surface configured to engage the jamb channel when the sash pivot is rotated to a first position.

BRIEF DESCRIPTION OF THE DRAWINGS

The exemplary embodiments of the present invention will become more fully understood from the following detailed description, taken in conjunction with the accompanying drawings, wherein like reference numerals refer to like elements, in which.

DETAILED DESCRIPTION OF THE PREFERRED EMBODIMENTS

Figure 1:
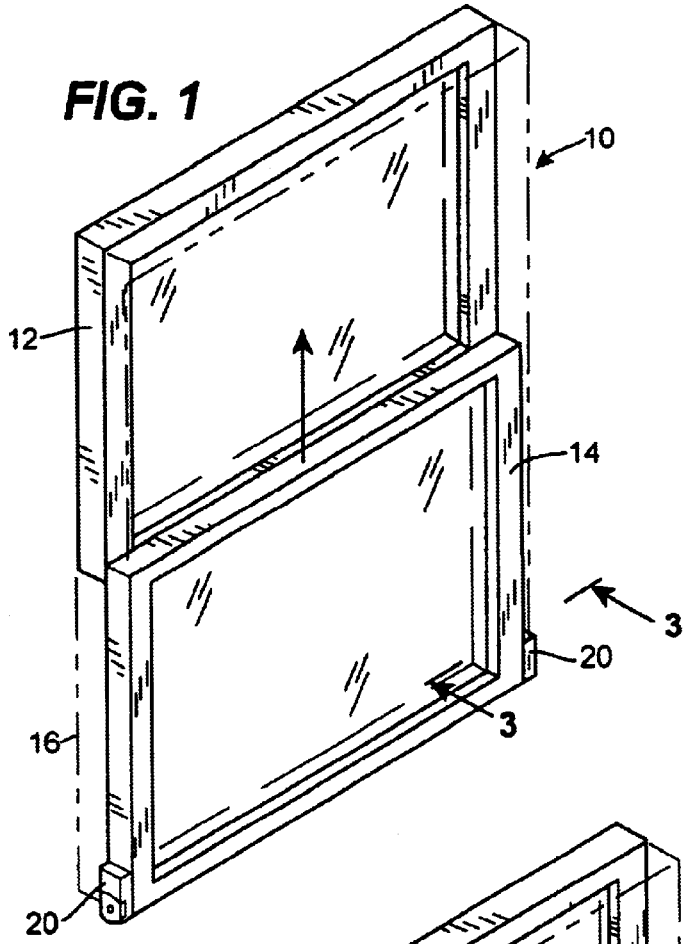
FIG. 1 is a perspective view of a double-hung tilt-out window showing the bottom sash in the closed position.
Figure 2:
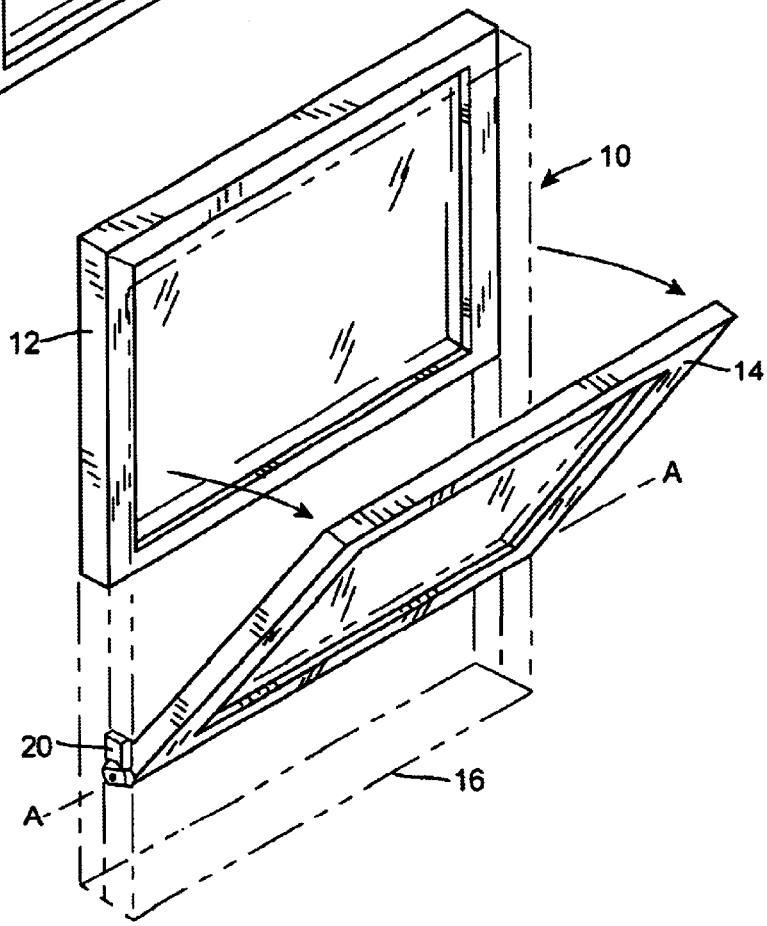
FIG. 2 is a perspective view of a double-hung tilt-out window showing the lower sash in a partially open and partially tilted out position.

Referring now to FIGS. 1 and 2, a double-hung tilt-out window 10 is depicted. Window 10 includes an upper sash 12 and a lower sash 14 supported in a frame 16. As shown partially in FIG. 3, frame 16 supports a jamb liner or jamb channel 18 that is configured to slidably support a guide assembly shown as a balance shoe assembly 20 (or a guide assembly). As depicted in FIGS. 1 and 2, balance shoe assembly 20 both engages and is slidably retained in jamb channel 18. As depicted in FIG. 2, balance shoe assembly 20 on each side of frame 16 act as pivot points (which form an axis A—A for pivotal movement of lower sash) when a window sash (e.g. lower sash 14), is tilted out from the window frame, as is done to provide convenient access to the opposing side of the window (e.g. for repair, painting, washing, or other activity) from within an interior space without having to remove the window. According to an alternative embodiment, upper sash 12 may include a set of balance shoe assemblies similar to balance shoe assembly 20, shown in FIG. 2 that are coupled to lower sash 14. An engagement/disengagement device such as, but not limited to, a sliding latch may be installed at the top of sashes 12 and 14 to engage or disengage sashes 12 or 14 from jamb channel 18. According to alternative embodiments, any of a wide variety of engagement/disengagement devices (e.g. spring-loaded latches, buttons, levers, etc.) may be used in the window.

Figure 4:
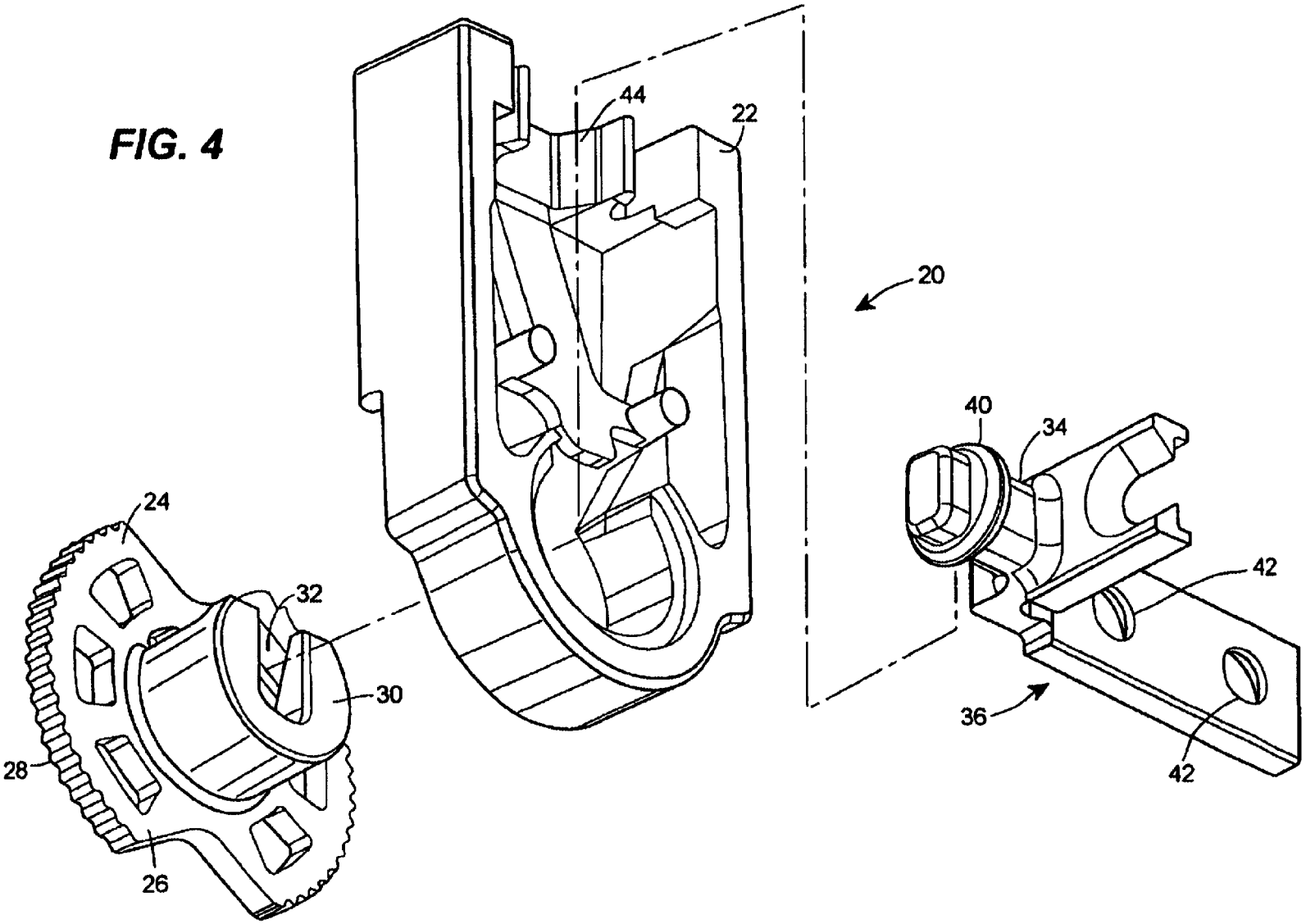
FIG. 4 is an exploded perspective view of a balance shoe assembly and the sash pivot pin.

Referring now to FIG. 4, an exploded view of balance shoe assembly 20 is depicted. Balance shoe assembly 20 includes a balance shoe housing 22 and a locking cam 24. Locking cam 24 includes a wheel 26 having a plurality of serrations 28 and a hub 30 with a retaining region 32. Retaining region 32 is configured to retain a sash pin 34 which is part of a sash pin assembly 36. Sash pin assembly 36 includes a base 38 and sash pin 34. According to a preferred embodiment, sash pin 34 may have a flange 40 and mounting holes 42 for mounting sash pin assembly 36 to a window sash, such as lower sash 14. Hub 30 also includes a tang 31 extending opposite retaining region 32 and configured to prevent locking cam 24 from inadvertent disassembly with housing 22.

Figure 9:
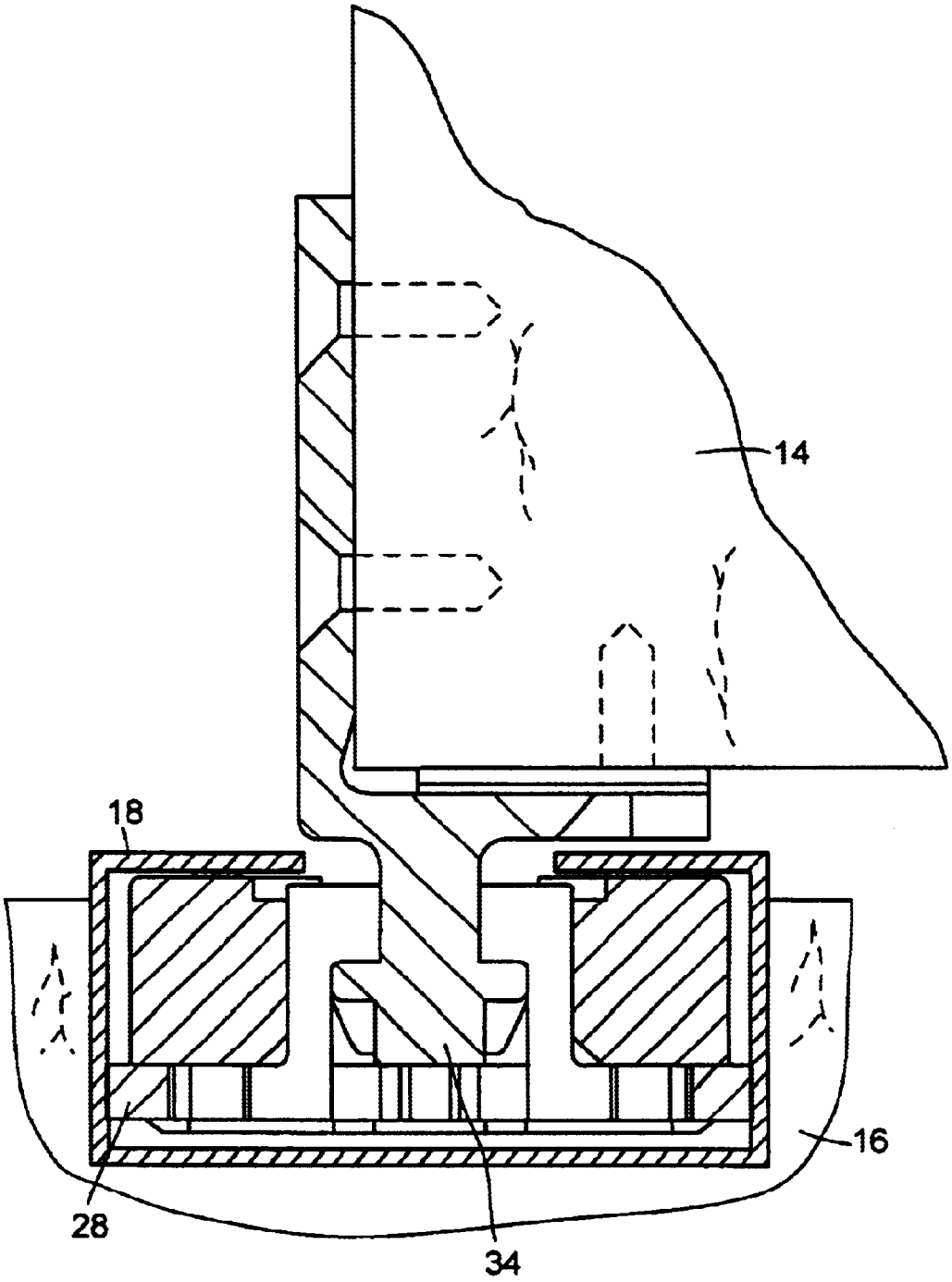
FIG. 9 is a cross-sectional view of the balance shoe assembly engaged with the sash pivot pin taken along the line 9—9 in FIG. 8.

According to a preferred embodiment, balance shoe assembly 20 is slidably captured within jamb channel 1 8, as depicted in FIG. 9. According to alternative embodiments, the balance shoe assemblies may be slidably retained in jamb channel by an interference fit. Also, in an alternative embodiment, the balance shoe assemblies may be configured to retain a balance spring within the balance shoe to counter balance the weight of a window sash. Alternatively, the balance shoe may be configured to be coupled to an end of a balance spring, to counter balance the weight of a window sash.

Figure 3:
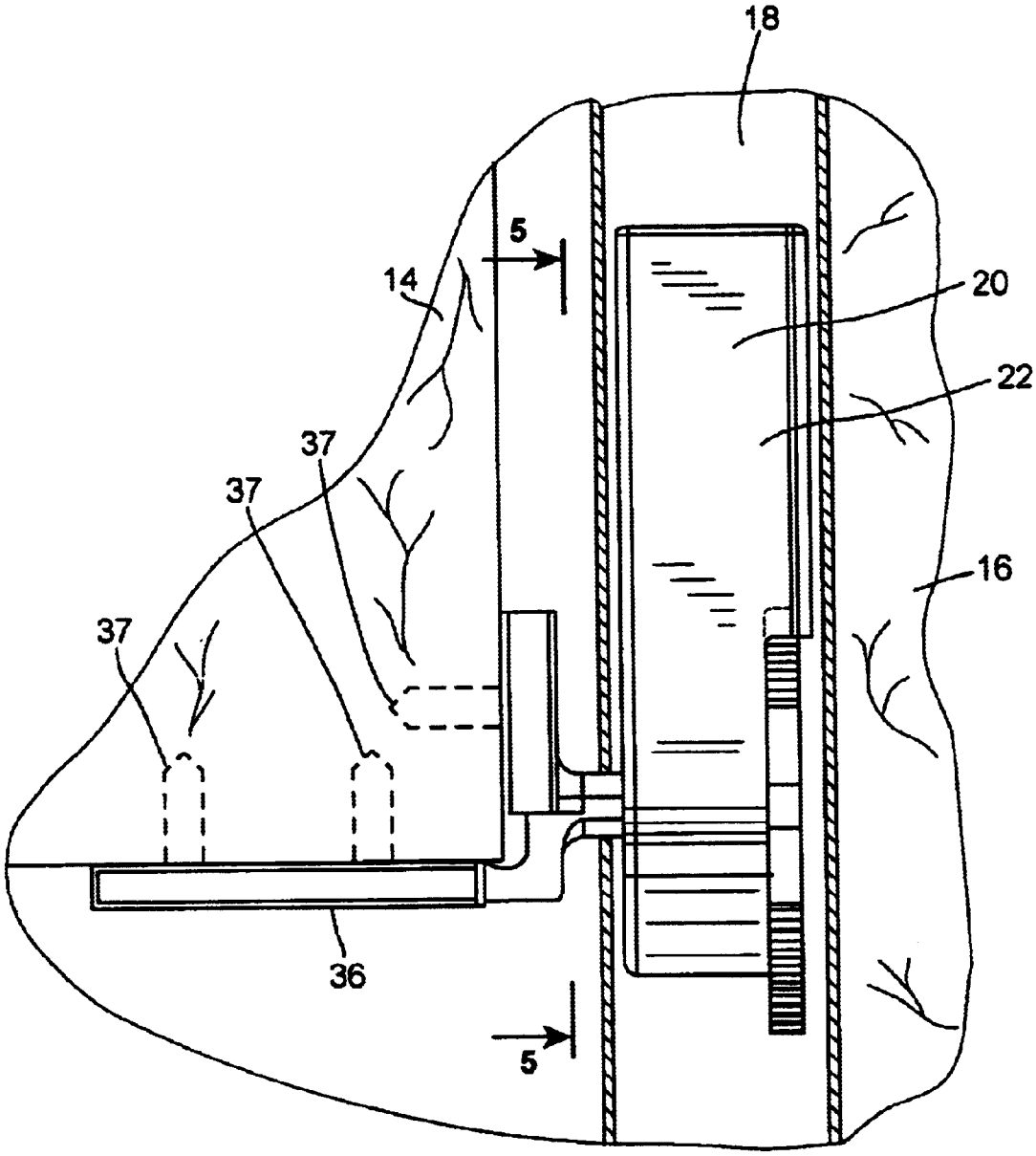
FIG. 3 is a side elevation view of the sash pivot pin engaging a balance shoe assembly.

As shown in FIG. 2, balance shoe assemblies 20 are installed at opposite sides of sash 14 (and alternatively, sash 12). As shown in FIG. 3, sash pins 34 are mounted to sash 14 by fasteners (such as screws 37) and are supported by balance shoe assemblies 20 for pivotal rotation. By pivotal rotation, sash 14 is tiltable about longitudinal axis A—A (FIG. 2) defined by sash pins 34 on each side of sash 14.

Figure 10:
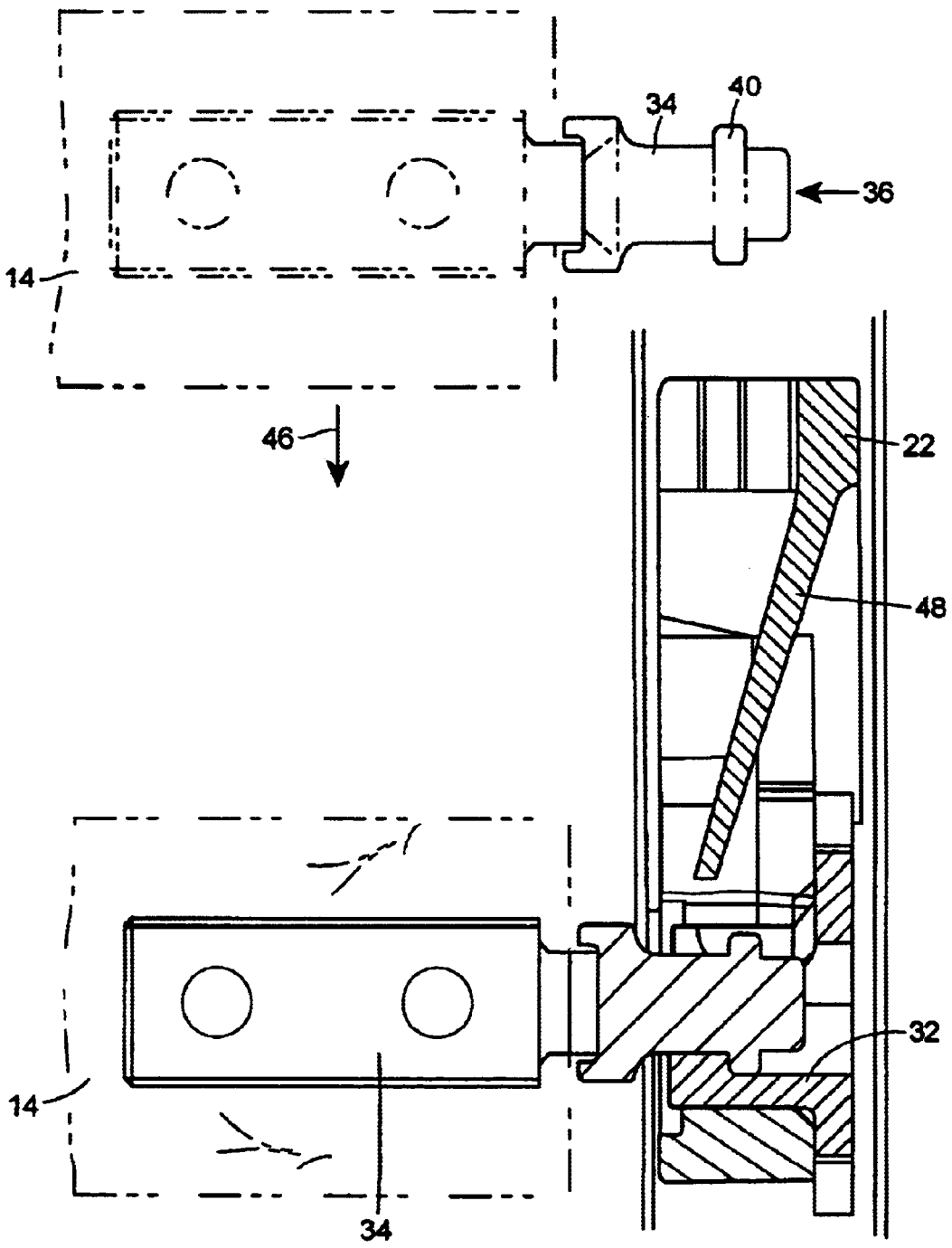
FIG. 10 is a cross-sectional view of the balance shoe assembly engaged with the pivot pin taken along the line 10—10 in FIG. 8.
Figure 11:
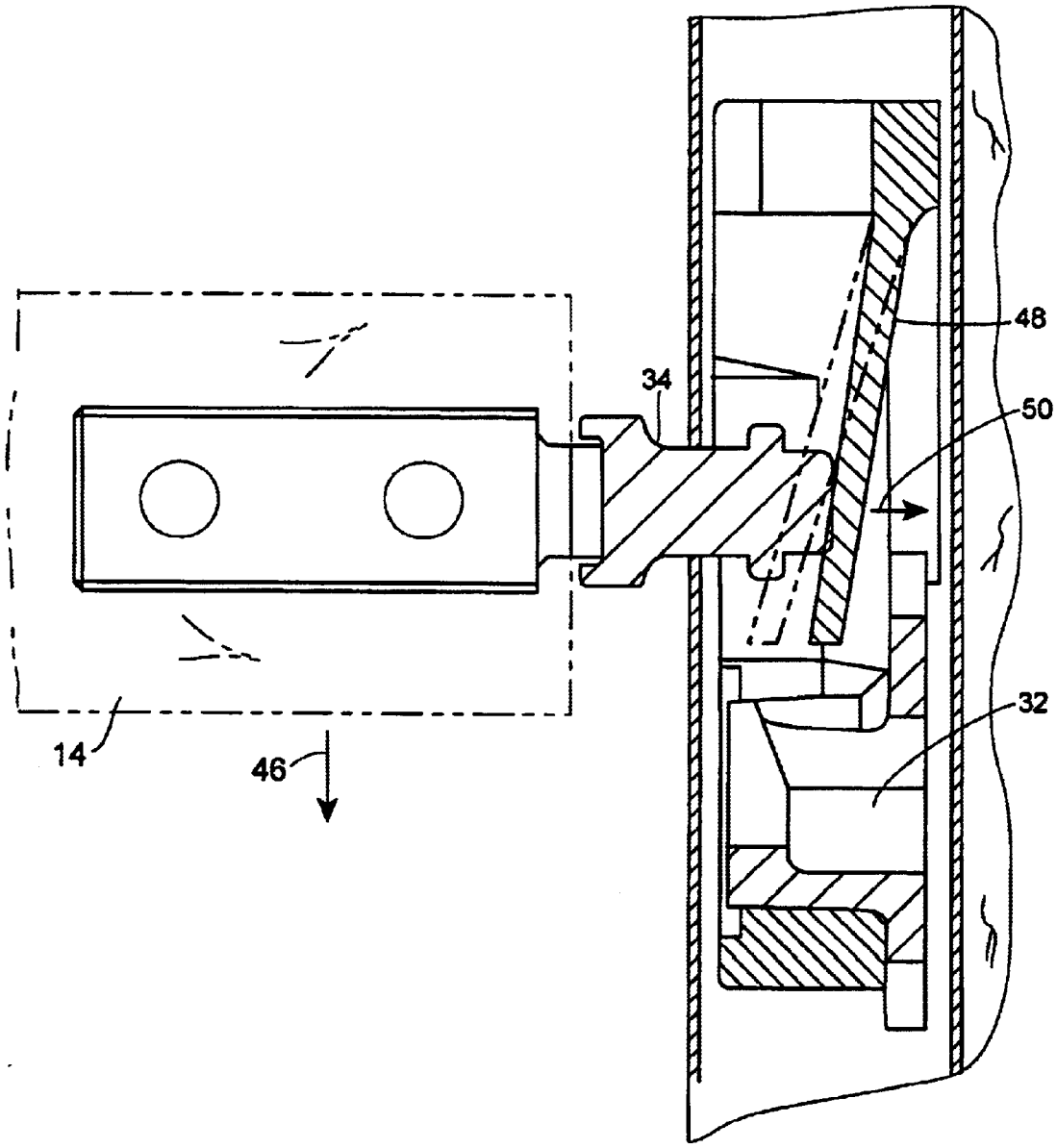
FIG. 11 is a cross-sectional view of the balance shoe assembly engaging the sash pivot pin and showing the spring retainer flexing as the sash pivot pin enters the sash pivot pin retaining region.

According to a preferred embodiment, to install a sash (such as sash 14) with a sash pin assembly 36 in a window frame 16, sash 14 is held substantially horizontal and each sash pin 34 is slid through a corresponding slot 44 in housing 22 of balance shoe assembly 20. Referring to FIG. 10, sash 14 and sash pin assembly 36 enter slot 44 in a direction depicted by arrow 46. As sash 14 is installed, sash pin 34 contacts a retaining spring 48 (according to a preferred embodiment, spring 48 is integrally or unitarily formed with housing 22). Spring 48 is shown as a cantilevered flexible member, according to a preferred embodiment. According to alternative embodiments, the spring may be various other forms of a cantilevered flexible structure, or other configurations may be used. As shown in FIG. 11, retaining spring 48 is deflected in a direction 50. When pin 34 is fully installed within retaining region 32 of locking cam 24, spring 48 returns to an unflexed position, as depicted in FIG. 10.

It should be noted that in an exemplary embodiment retainer spring 48 is integrally formed with housing 22 to provide the advantage of reduced complexity and simplified assembly, resulting in overall cost savings in the manufacturing of balance shoe assembly 20. In an exemplary embodiment in which retainer spring 48 is integrally molded with housing 22, the fabrication of housing 22 requires less complex tooling. For example, housing 22 may be a molded polymer (or other applicable material), the molding of which does not requires separate cores or paddles to be used, thereby resulting in simplified manufacturing processes.

Figure 12:
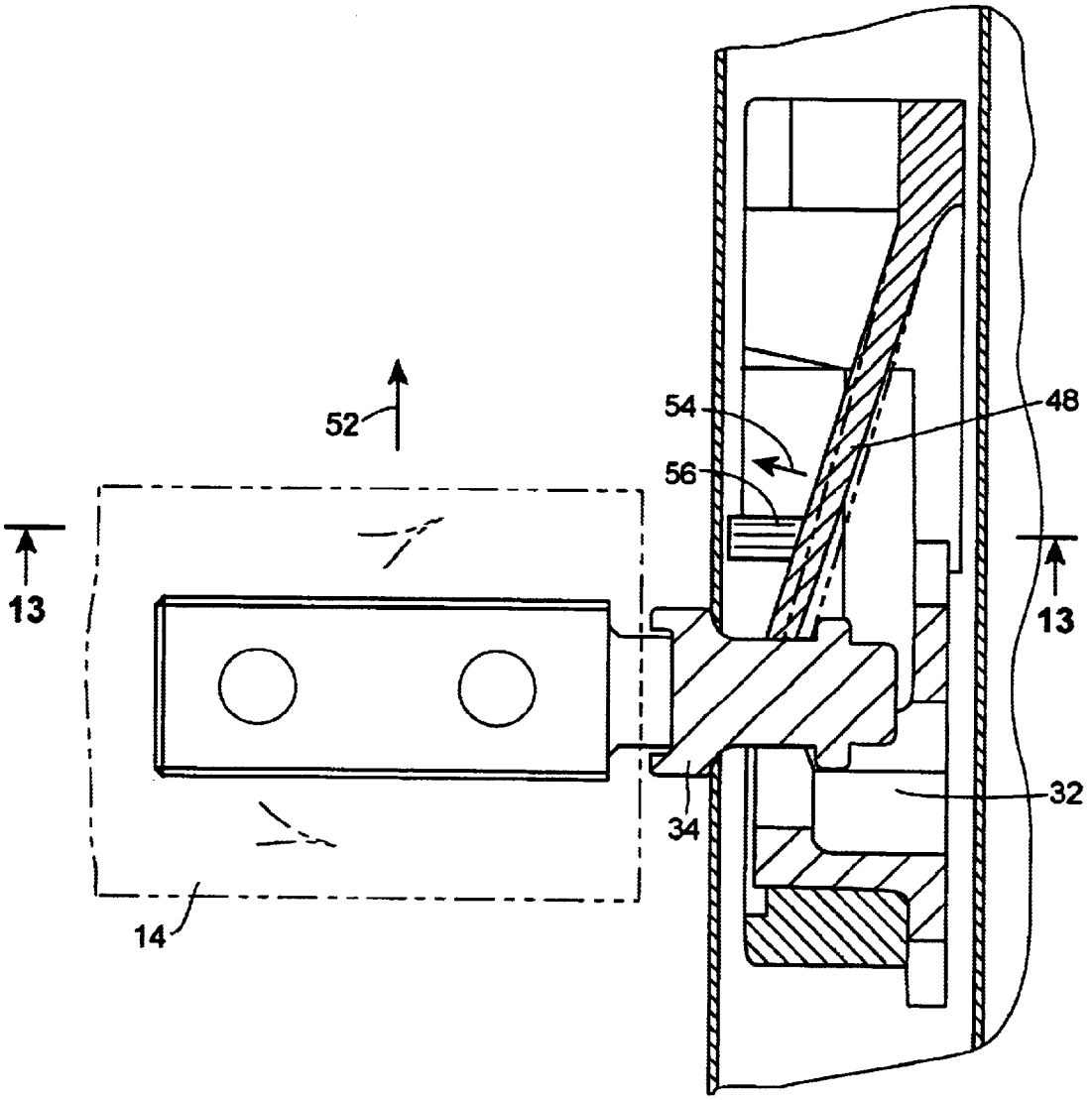
FIG. 12 is a cross-sectional view of the balance shoe assembly similar to FIG. 11 but showing the sash pivot pin retained in the pivot pin retaining region and further showing the spring retainer retaining the sash pivot pin.
Figure 13:
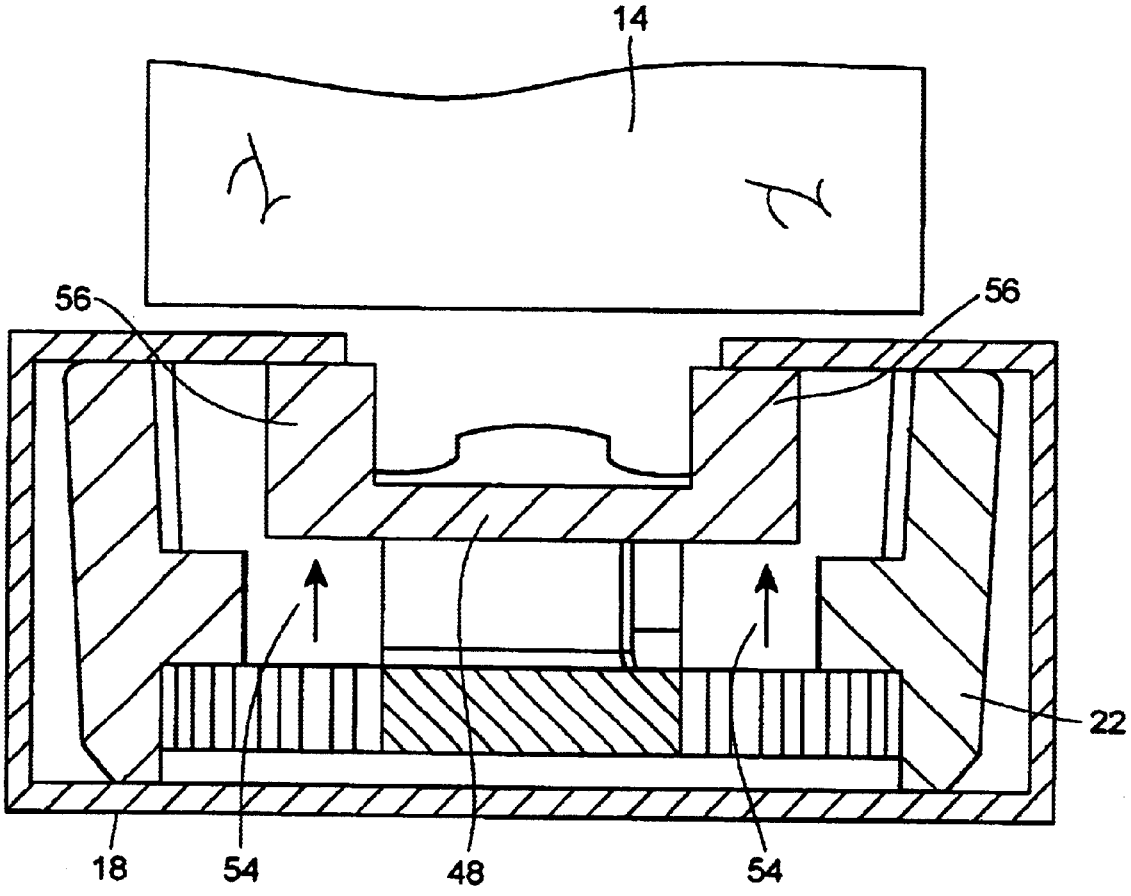
FIG. 13 is a cross-sectional view taken along the line 13—13 in FIG. 12 and showing the spring retainer stops engaging the jamb channel.

Once pin 34 is retained in retaining region 32, a movement of sash 14 in a direction, indicated by arrow 52, as depicted in FIG. 12, causes pin 34 to engage retaining spring 48 and causes retaining spring 48 to flex in a direction indicated by arrow 54. Retaining spring 48 includes stops that engage jamb channel 18, as depicted in FIG. 13. Stops 56 prevent retaining spring 48 from over-flexing and potentially breaking from housing 22. Further, stops 56 prevent retaining spring 48 from substantial deflection, thereby aiding in the retention of pin 34 in retaining region 32. To remove sash 14 from retaining pin 34, a retaining spring 48 is pushed in a direction 58, depicted in FIG. 14, by using a finger or a tool 60 that causes spring 48 to flex and thereby provide clearance for pin 34 to slide out of retaining region 32 in the direction indicated by arrow 59.

Figure 5:
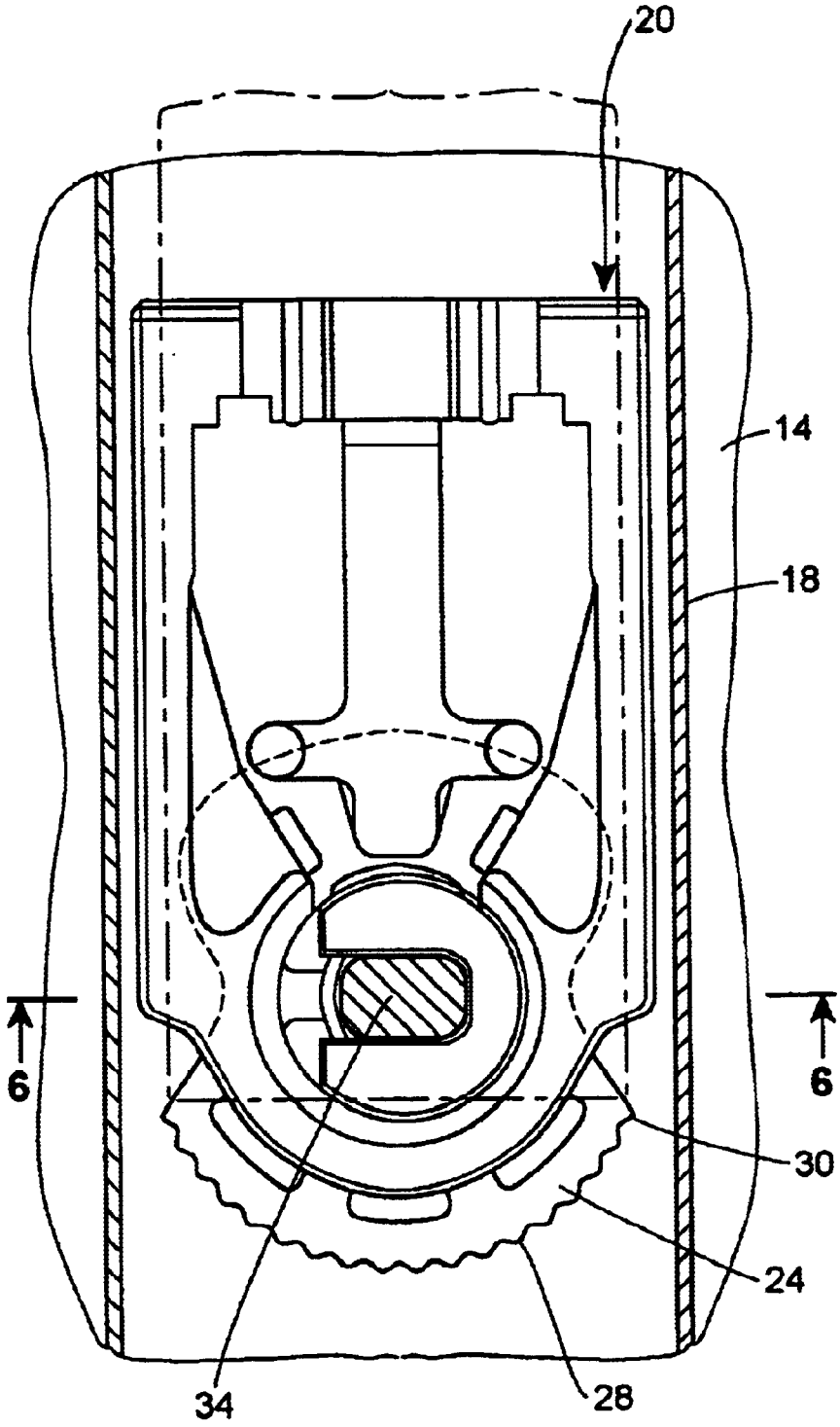
FIG. 5 is an elevational view of the balance shoe assembly.
Figure 6:
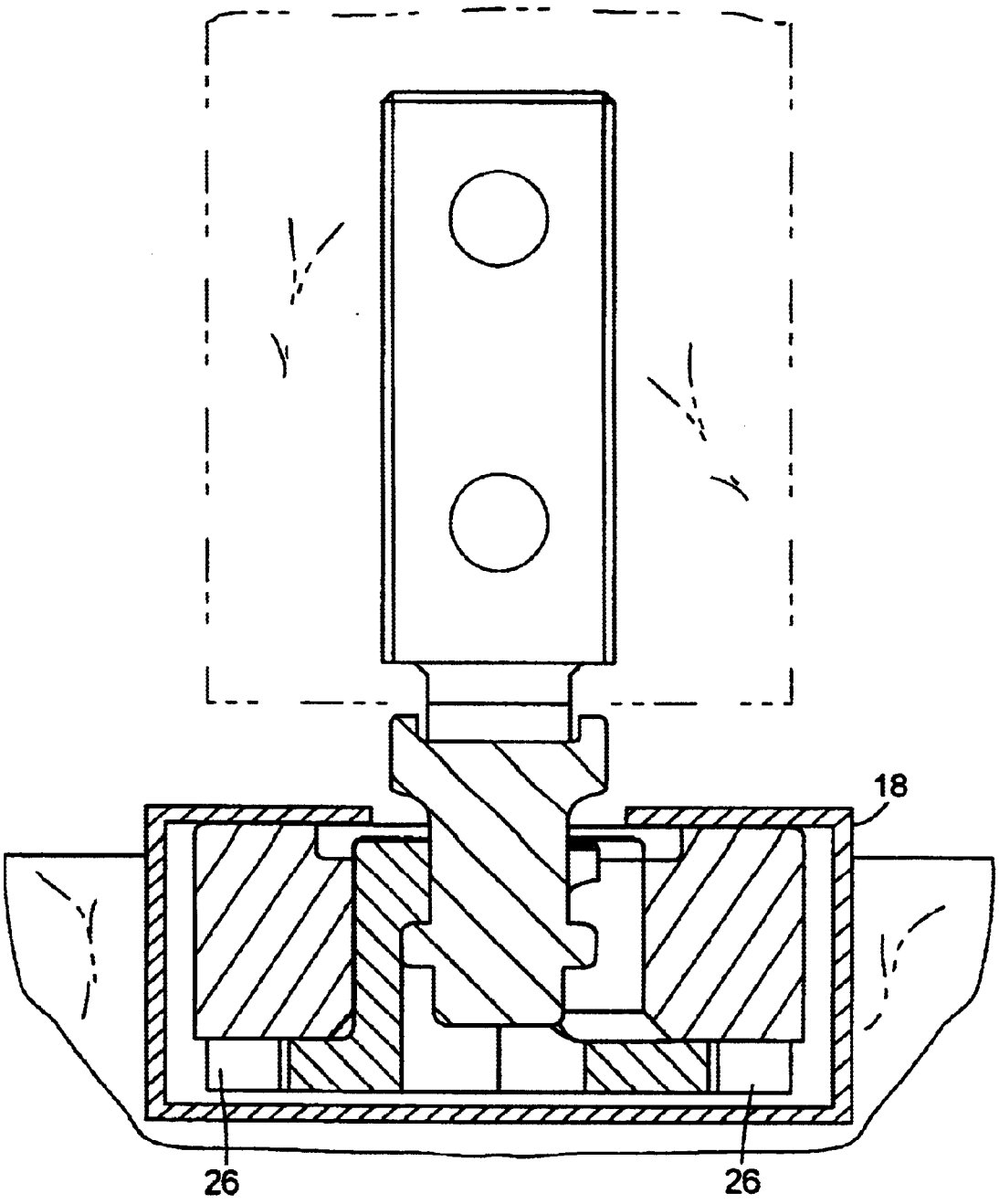
FIG. 6 is a cross-sectional view of the balance shoe assembly and sash pivot pin taken along the line 6—6 in FIG. 5.

When sash 14 is in the fully tilted up position, like that shown in FIG. 1, hub 30 of locking cam 24 is in the position shown in FIG. 5, whereby pin 34 is retained in hub 30. In the fully tilted up position, sash 14, engaged with balance shoe assembly 20, may slide up and down while being retained within jamb channel 18, as shown in FIGS. 5 and 6. As shown in FIGS. 5 and 6, serrations 28 do not interfere with, engage, or substantially prevent balance shoe assembly 20 from moving within jamb channel 18 when sash 14 is in the fully tilted-up position.

Figure 7:
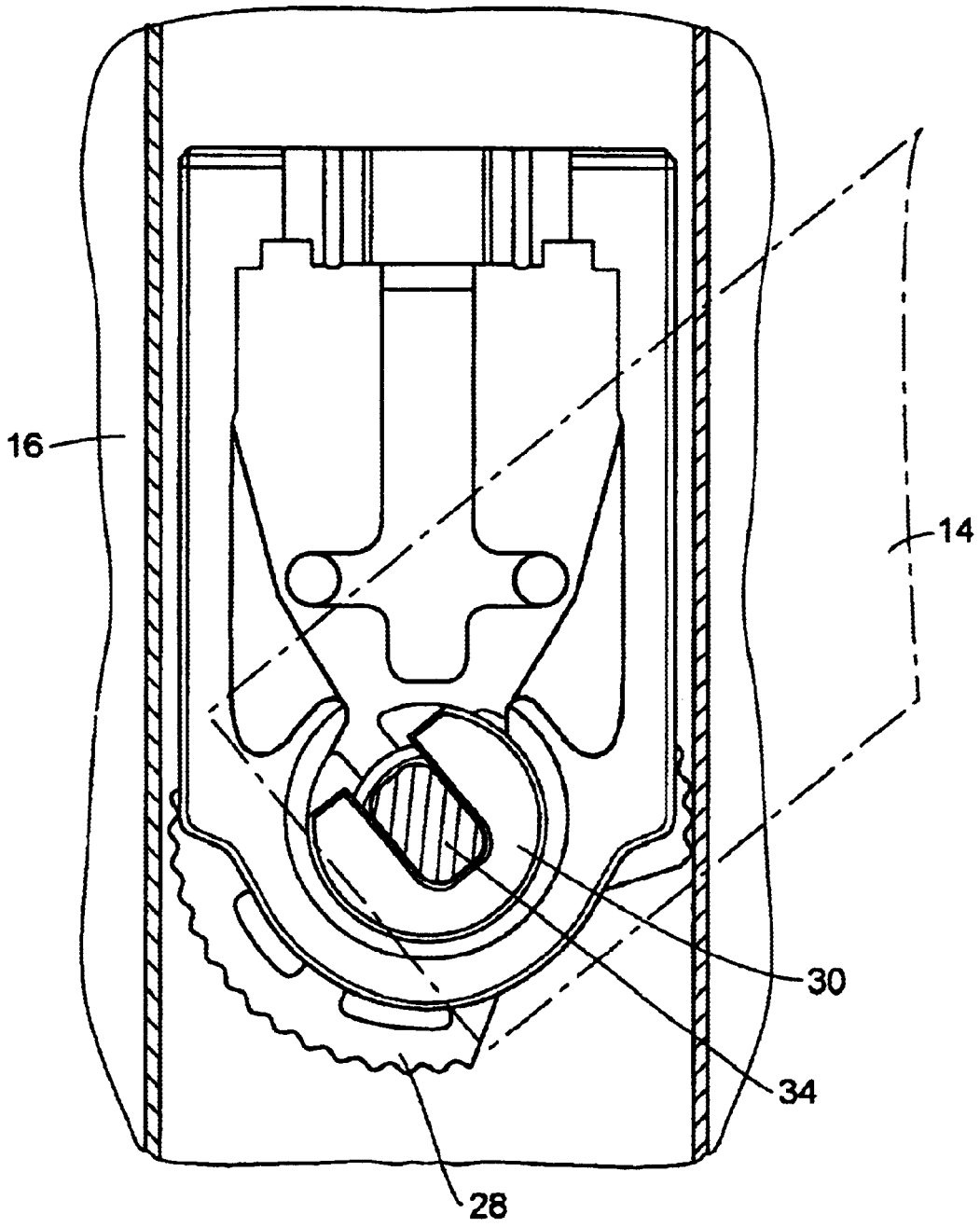
FIG. 7 is an elevational view of the balance shoe assembly showing the window sash in a partially tilted out position.
Figure 8:
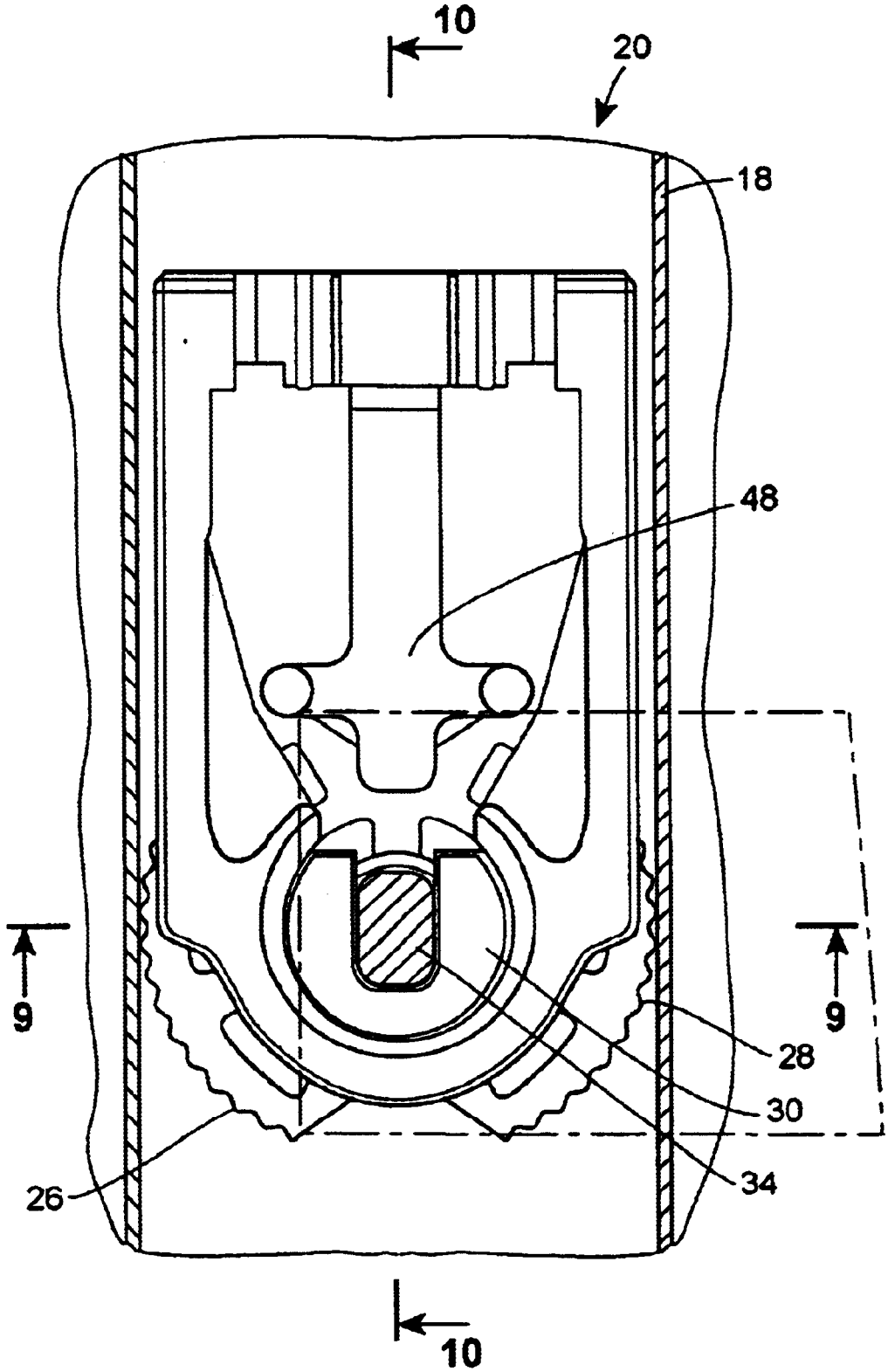
FIG. 8 is an elevational view of the balance shoe assembly showing the window sash in the fully tilted out position.
Figure 14:
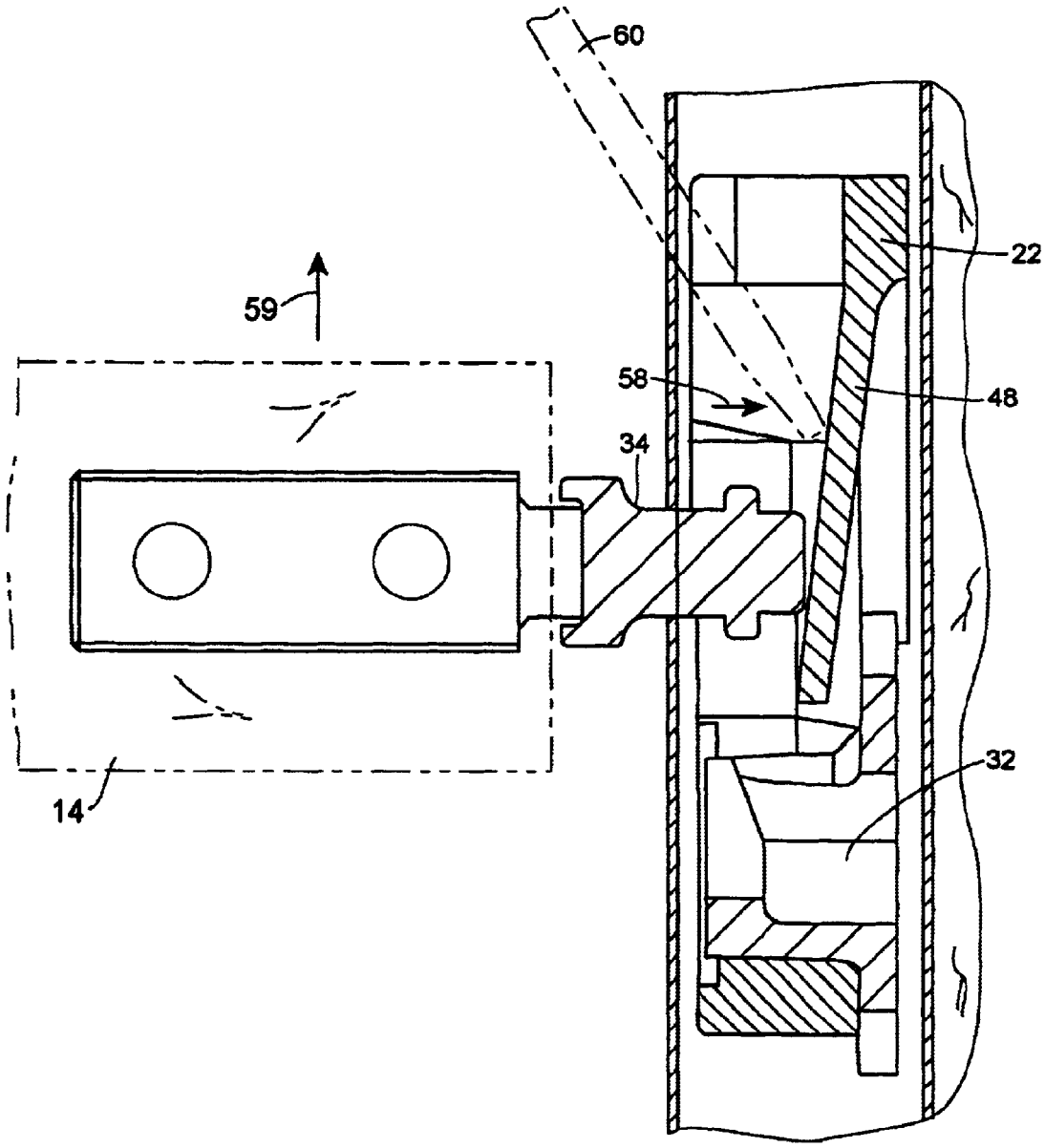
FIG. 14 is a cross-sectional view of the balance shoe assembly showing the spring retainer being flexed so that the pivot pin may be removed from the retaining region.

As depicted in FIG. 7, when sash 14 is tilted out of frame 16, pin 34 causes hub 30 to rotate and causes locking or engagement surfaces, shown as serrations 28, to engage jamb channel 18, as shown in FIGS. 8 and 9. As sash 14 reaches the fully horizontal position, as shown in FIG. 8, balance shoe assembly 20 is prevented from moving (e.g., sliding) within jamb channel 18 because serrations 28 provide a frictional and interfering engagement with jamb channel 18 thereby preventing any movement either when an individual is working on sash 14 or when a user is removing sash 14 (as depicted in FIG. 14). Further, when sash 14 is in the position shown in FIG. 8, the pin may be removed from retention in hub 30 of locking cam 26 by deflecting retaining spring 48 as depicted in FIG. 14. Spring 48 may be deflected by pressing using a finger or any appropriate tool, such as tool 60.

According to a preferred embodiment, balance shoe assembly 20 may be manufactured from molded plastic. According to alternative embodiments, balance shoe assembly 20 may be made from materials, such as, but not limited to, metallic, polyester, nylon, composite materials, and other well known polymers. Further, it should be noted that balance shoe assembly 20 is configured for easy assembly because balance shoe assembly 20 includes two parts, housing 22 and locking cam 26 that interact with a sash pivot assembly 36. Because of the limited number of parts and the ability of the parts to be manufactured through a molding process, balance shoe assembly 20 may be simply assembled and may be manufactured relatively inexpensively. Balance shoe assembly 20 described above may be suitably used in a variety of window/window frame arrangements including, but not limited to, any of a variety of sliding window arrangements. Alternatively, a plurality of different retainer spring arrangements may be provided within housing 22 to retain the pivot pin within housing 22.

The method of assembly and/or use of the guide assembly, according to preferred and alternative embodiments, may be performed in various steps; any omissions or additions of steps to those steps disclosed, or any departure from the order or sequences of steps recited, should be considered to fit within the spirit and scope of the invention.

While the detailed drawings, specific examples, and particular formulations given describe preferred or exemplary embodiments, they serve the purpose of illustration only. The materials and configurations shown and described may differ depending on the chosen performance characteristics and physical characteristics of the window and frame, for example, the jamb channel or jamb liner may differ in geometry than that disclosed. As another example, the geometry of the locking cam and/or the balance shoe housing may be markedly different while providing the same structure and function as within the spirit and scope of the invention. The apparatus of the invention is not limited to the precise details and conditions disclosed. Furthermore, other substitutions, modifications, changes, and omissions may be made in the design, operating conditions and arrangements of the preferred embodiments without departing from the spirit of the invention as expressed in the appended claims.

What is claimed is:

1. A guide assembly for translationally and pivotally mounting a window sash to a window frame providing a window jamb having a jamb channel, the guide assembly comprising:

a housing configured for translating movement within the jamb channel;

a locking cam rotatably coupled to the housing, the locking cam including a plurality of integral serrations which rotate with the locking cam; and a sash pivot configured to be coupled to the window sash and to the locking cam so that the locking cam rotates with the sash pivot;

wherein the locking cam serrations engage the jamb channel when the sash pivot is rotated to a first position.

2. The guide assembly of claim 1 wherein the housing includes a retainer spring configured to retain the sash pivot.

3. The guide assembly of claim 1 wherein the surface includes a plurality of serrations.

4. The guide assembly of claim 1 wherein the sash pivot is removable from the sash pivot retaining region when the locking cam is in the first position.

5. The guide assembly of claim 1 wherein the sash pivot is captured in the sash pivot retaining region when the sash pivot is rotated to a second position.

6. The guide assembly of claim 1 wherein the locking cam is substantially a locking wheel.

7. A guide assembly for translationally and pivotably mounting a window sash to a window frame providing a window jamb having a channel, the guide assembly comprising:

a housing configured for translating movement within the jamb channel, wherein the housing includes a retainer spring configured to retain the sash pivot, the retainer spring including a stop configured to engage the jamb channel when the sash pivot engages the retainer spring;

a sash pivot configured to be coupled to the window sash; and a locking cam rotatably coupled to the housing, the locking cam including a sash pivot retaining region, the locking cam including a surface configured to engage the jamb channel when the sash pivot is rotated to a first position.

8. A window comprising:

a window frame having a jamb channel;

a window sash movable relative to the window frame;

a shoe housing including a sliding surface for guiding the housing in the jamb channel;

a locking cam rotatably coupled to the shoe housing, the locking cam including a plurality of integral serrations which rotate with the locking cam; and a sash pivot configured to be coupled to the window sash and to the locking cam so that the locking cam rotates with the sash pivot;

wherein the locking cam serrations engage the jamb channel when the sash pivot is rotated to a first position.

9. The locking sash shoe of claim 8 wherein the shoe housing includes a retainer spring configured to retain the sash pivot.

10. The locking sash shoe of claim 8 wherein the locking surface includes a plurality of serrations.

11. The locking sash shoe of claim 8 wherein the sash pivot is removable from the sash pivot retaining region when the locking cam is in the first position.

12. The locking sash shoe of claim 8 wherein the sash pivot is captured in the sash pivot retaining region when the sash pivot is rotated to a second position.

13. The locking sash shoe of claim 8 wherein the locking cam is substantially a locking wheel.

14. A window comprising:

a window frame having a jamb channel;

a window sash movable relative to the window frame;

a shoe housing including a sliding surface for guiding the housing in the jamb channel, the shoe housing including a retainer spring configured to retain the sash pivot, the retainer spring including a stop configured to engage the jamb channel when the sash pivot engages the retainer spring;

a sash pivot configured to be coupled to the window sash; and a locking cam rotatably coupled to the shoe housing, the locking cam including a sash pivot retaining region, the locking cam configured to rotate substantially with the sash pivot, and the locking cam including a locking surface configured to engage the jamb channel when the sash pivot is rotated to a first position.

15. A locking sash shoe for slidably and pivotably mounting a window sash to a window jamb, having a jamb channel, the sash shoe comprising:

a shoe housing including a sliding surface for guiding the housing in the jamb channel;

a locking cam rotatably coupled to the shoe housing, the locking cam including a plurality of integral serrations which rotate with the locking cam; and a sash pivot configured to be coupled to the window sash and to the locking cam so that the locking cam rotates with the sash pivot;

wherein the locking cam serrations engage the jamb channel when the sash pivot is rotated to a first position.

16. The locking sash shoe of claim 15 wherein the shoe housing includes a retainer spring integrally formed with the shoe housing, the retainer spring configured to retain the sash pivot.

17. The locking sash shoe of claim 15 wherein the locking surface includes a plurality of serrations.

18. The locking sash shoe of claim 15 wherein the sash pivot is removable from the sash pivot retaining region when the locking cam is in the first position.

19. The locking sash shoe of claim 15 wherein the sash pivot includes a flange and the flange is configured to aid in retaining the sash pivot in the sash pivot retaining region.

20. A locking sash shoe for slidably and pivotably mounting a window sash to a window jamb, having a jamb channel, the sash shoe comprising:

a shoe housing including a sliding surface for guiding the housing in the jamb channel, the shoe housing including a retainer spring integrally formed with the shoe housing, the retainer spring configured to retain the sash pivot, the retainer spring including a stop integrally formed with the retainer spring, the stop configured to engage the jamb channel when the sash pivot engages the retainer spring;

a sash pivot configured to be coupled to the window sash; and a locking cam rotatably coupled to the shoe housing, the locking cam including a sash pivot retaining region, the locking cam configured to rotate substantially with the sash pivot, and the locking cam including an integrally formed locking surface configured to engage the jamb channel when the sash pivot is rotated to a first position.

21. A locking sash shoe for slidably and pivotably mounting a window sash to a window jamb, having a jamb channel, the sash shoe comprising:

a sash pivot configured to be coupled to the window sash;

a shoe housing including a sliding surface for guiding the housing in the jamb channel and the shoe housing including a retainer spring integral with the shoe housing, the retainer spring configured to retain the sash pivot; and a locking cam rotatably coupled to the shoe housing, the locking cam including a plurality of serrations which engage the window jamb in a rotational manner.

22. (Thrice Amended) A window comprising:

a window frame having a jamb channel;

a window sash movable relative to the window frame;

a sash pivot configured to be coupled to the window sash;

a shoe housing including a sliding surface for guiding the housing in the jamb channel and the shoe housing including a retainer spring integral with the shoe housing and configured to retain the sash pivot; and a locking cam rotatably coupled to the shoe housing, the locking cam including a plurality of serrations which engage the window jamb in a rotational manner.

* * * * *

UNITED STATES PATENT AND TRADEMARK OFFICE

CERTIFICATE OF CORRECTION

PATENT NO. : 6,658,794 B1
DATED : December 9, 2003
INVENTOR(S) : Hansel et al.

It is certified that error appears in the above-identified patent and that said Letters Patent is hereby corrected as shown below:

Column 8,
Line 39, please delete "(Thrice Amended) A window" and insert -- A window --.

Signed and Sealed this

Thirteenth Day of July, 2004

JON W. DUDAS
*Acting Director of the United States Patent and Trademark Office*